US008943789B2

(12) United States Patent
Takeuchi et al.

(10) Patent No.: US 8,943,789 B2
(45) Date of Patent: Feb. 3, 2015

(54) HYBRID CORE ROPE

(71) Applicant: Tokyo Rope Manufacturing Co., Ltd., Tokyo (JP)

(72) Inventors: Jun Takeuchi, Tokyo (JP); Kaori Ichikawa, Tokyo (JP)

(73) Assignee: Tokyo Rope Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/892,067

(22) Filed: May 10, 2013

(65) Prior Publication Data

US 2013/0318937 A1 Dec. 5, 2013

(30) Foreign Application Priority Data

May 31, 2012 (JP) ..... 2012-124521

(51) Int. Cl.
*D07B 1/06* (2006.01)
*D07B 1/14* (2006.01)
(Continued)

(52) U.S. Cl.
CPC ..... *D07B 1/0686* (2013.01); *D07B 1/144* (2013.01); *D07B 5/12* (2013.01); *D07B 7/025* (2013.01); *D07B 2201/108* (2013.01); *D07B 2201/2024* (2013.01); *D07B 2201/2049* (2013.01); *D07B 2201/2052* (2013.01); *D07B 2201/2053* (2013.01); *D07B 2201/2057* (2013.01); *D07B 2201/2058* (2013.01); *D07B 2201/2059* (2013.01); *D07B 2201/206* (2013.01); *D07B 2201/2076* (2013.01);
(Continued)

(58) Field of Classification Search
CPC ..... D07B 1/0686
USPC ..... 57/212, 218, 220, 222, 224, 231
See application file for complete search history.

(56) References Cited

U.S. PATENT DOCUMENTS 1,183,487 A * 5/1916 Parker ..... 57/219
2,480,005 A * 8/1949 Ewell ..... 57/220
(Continued)

FOREIGN PATENT DOCUMENTS

CH 689-098 A5 9/1998
CN 102345237 A 2/2012
(Continued)

OTHER PUBLICATIONS

European Search Report dated Jan. 7, 2014.
(Continued)

*Primary Examiner* — Shaun R Hurley
(74) *Attorney, Agent, or Firm* — McGinn IP Law Group, PLLC

(57) ABSTRACT

The present invention is to provide a hybrid core rope which does not require maintenance or a hybrid core rope capable of reducing a maintenance task. The hybrid core rope includes a resin solid core in which a plurality of spiral grooves is formed in the longitudinal direction on an outer peripheral surface thereof, a plurality of fiber bundles respectively spirally wound around the outer peripheral surface of the resin solid core along the plurality of spiral grooves, the fiber bundles having thickness to fill the spiral grooves, and a plurality of steel strands spirally wound around the outer peripheral surface of the resin solid core around which the fiber bundles are wound. The fiber bundles and the strands are respectively wound so as to have angles which are not parallel to each other.

14 Claims, 6 Drawing Sheets

(51) Int. Cl.
*D07B 5/12* (2006.01)
*D07B 7/02* (2006.01)

(52) U.S. Cl.
CPC .... *D07B 2205/106* (2013.01); *D07B 2401/206* (2013.01); *D07B 1/14* (2013.01)
USPC ..... 57/220

(56) References Cited

U.S. PATENT DOCUMENTS

| | | | | | |
|---|---|---|---|---|---|
| 3,018,607 | A | * | 1/1962 | Dietz et al. | 57/214 |
| 3,716,982 | A | * | 2/1973 | Morohashi et al. | 57/212 |
| 4,120,145 | A | * | 10/1978 | Chiappetta et al. | 57/221 |
| 4,176,705 | A | * | 12/1979 | Russell et al. | 152/527 |
| 4,202,382 | A | * | 5/1980 | Westhead | 139/383 A |
| 4,422,286 | A | | 12/1983 | Simpson et al. | |
| 5,171,942 | A | | 12/1992 | Powers | |
| 5,269,128 | A | * | 12/1993 | Walton et al. | 57/210 |
| 5,797,254 | A | * | 8/1998 | Walton | 57/220 |
| 6,007,912 | A | * | 12/1999 | Doujak | 428/379 |
| 6,334,293 | B1 | * | 1/2002 | Poethke et al. | 57/210 |
| 6,363,703 | B1 | * | 4/2002 | Kolmes | 57/210 |
| 6,412,263 | B1 | * | 7/2002 | Lee et al. | 57/210 |
| 6,412,264 | B1 | * | 7/2002 | De Josez et al. | 57/217 |
| 6,563,054 | B1 | * | 5/2003 | Damien et al. | 174/120 C |
| 6,779,950 | B1 | * | 8/2004 | Hutchins | 405/259.1 |
| 7,228,681 | B2 | * | 6/2007 | Meersschaut et al. | 57/213 |
| 8,079,208 | B2 | * | 12/2011 | Volpi | 57/222 |
| 8,176,718 | B2 | * | 5/2012 | Ridge et al. | 57/212 |
| 8,375,692 | B2 | * | 2/2013 | Rebouillat et al. | 57/210 |
| 2003/0106300 | A1 | * | 6/2003 | Bruyneel et al. | 57/212 |
| 2011/0198008 | A1 | | 8/2011 | Pottier et al. | |
| 2012/0180926 | A1 | * | 7/2012 | Rebouillat et al. | 152/527 |
| 2013/0227926 | A1 | * | 9/2013 | Amils et al. | 57/218 |

FOREIGN PATENT DOCUMENTS

| | | | |
|---|---|---|---|
| GB | 2 219 014 | A | 11/1989 |
| JP | 2892842 | B2 | 5/1999 |
| JP | 2011-89221 | A | 5/2011 |
| KR | 2002-0094648 | | 12/2002 |

OTHER PUBLICATIONS

Search Report from Intellectual Property Office of Singapore dated Aug. 4, 2014.

* cited by examiner

HYBRID CORE ROPE

BACKGROUND OF THE INVENTION

1. Field of the Invention

The present invention relates to a hybrid core rope used for a cableway of an elevator, a crane, a ropeway, a lift, or the like, facilities for fisheries such as trawling, and other purposes.

2. Description of the Related Art

There is a known fiber core rope in which a plurality of steel strands is twisted around a fiber core. By containing oil in the fiber core, the oil is supplied between the strands and between steel wires forming the strands during use. Thus, the fiber core rope has a favorable lubricating property between the fiber core rope and a sheave and the like. However, upon continuous use, the oil is gradually withdrawn, so that a diameter decrease rate of a rope diameter (a rate of reduction in rope diameter) is high. When the rope diameter is decreased, structural extension generated in the rope is also increased. Maintenance such as a task of shortening an extended part is unavoidably required.

There is also a known solid core rope in which a resin solid core (resin core) is used in place of the fiber core and a plurality of steel strands is twisted around this solid core. Since the steel strands are supported by the solid core, a diameter decrease rate of a rope diameter of the solid core rope is low, and extension is also small. However, since the solid core cannot contain oil, maintenance of regularly applying a lubricant from the outside is unavoidably required.

Japanese Patent No. 2892842 discloses a wire rope in which eight steel strands 12 are twisted around a core 11 provided with a core portion 14 made of plastic, rubber, or the like, and a natural fiber oil-containing portion 15 spirally wound around an outer periphery of the core portion 14. Although the core portion 14 provides suppression to some extent, due to the natural fiber (the oil-containing portion 15) wound around the entire outer periphery of the core portion 14, the fact remains that a diameter of the wire rope is decreased upon continuous use. It is thought that maintenance such as a task of shortening an extended part is required.

SUMMARY OF THE INVENTION

An object of this invention is to provide a rope which does not require maintenance or a rope capable of reducing a maintenance task.

An object of this invention is to provide a rope in which rust is not easily generated.

Further, an object of this invention is to provide a rope in which a strength decrease is small even after long-term use.

Further, an object of this invention is to provide a rope having equal fatigue resistance to a solid core rope and also having an oil supplementing property.

A hybrid core rope according to this invention includes a resin solid core in which a plurality of spiral grooves is formed in the longitudinal direction on an outer peripheral surface thereof, a plurality of fiber bundles respectively spirally wound around the outer peripheral surface of the resin solid core along the plurality of spiral grooves, the fiber bundles having thickness to fill the spiral grooves, and a plurality of steel strands spirally wound around the outer peripheral surface of the resin solid core around which the fiber bundles are wound, wherein the fiber bundles and the strands are respectively wound so as to have angles which are not parallel to each other.

The fiber bundles are respectively wound around the plurality of grooves spirally formed on the outer peripheral surface of the resin solid core, and further, the plurality of strands is spirally wound around the outer peripheral surface of the resin solid core around which the fiber bundles are wound. In this specification, a combination of the resin solid core described above and the fiber bundles wound around the resin solid core is particularly called as the "hybrid core", and the rope having the hybrid core is considered as the "hybrid core rope". According to this invention, the fiber bundles and the strands are respectively wound so as to have the angles which are not parallel to each other. Thus, the plurality of strands is in contact with the fiber bundles at a certain position in the longitudinal direction of the hybrid core rope and in contact with the resin solid core at the other position. The plurality of strands is respectively supported by the resin solid core. Thus, even when tension is applied to the hybrid core rope during use and a force toward a center of the hybrid core rope is added, deformation in the diameter direction is suppressed. That is, a diameter decrease rate of a rope diameter is low. Since the diameter decrease rate is low, extension of the rope generated due to use of the hybrid core rope is also small. Therefore, maintenance including a task of shortening a part extended due to use can be eliminated or the number of the maintenance can be reduced.

The hybrid core rope according to this invention has the plurality of fiber bundles respectively in contact with the plurality of strands in an inner layer thereof. Thus, by containing oil in the fiber bundles, the oil can be supplied between the strands and between steel wires forming the strands during use. There is no need for regularly applying a lubricant (such as grease) to outer peripheral surfaces of the strands. A maintenance task for maintaining a lubricating property between the rope and a sheave and the like can be reduced. Even when the oil is withdrawn from the fiber bundles, the plurality of strands is respectively supported by the resin solid core as described above. Thus, a large diameter decrease as the conventional fiber core rope is not generated.

A rope in which not fiber bundles but only a resin solid core is used delivers a performance which is equal to or greater than the hybrid core rope for the diameter decrease rate of the rope diameter and the extension rate except the maintenance task for maintaining the lubricating property. However, in the solid core rope in which only a resin solid core is used, oil cannot be spread between strands and between steel wires forming the strands. Thus, fretting wear (wear due to rubbing) between the strands and between the steel wires forming the strands during use is relatively severe. Therefore, upon continuous use, rust is generated on a surface of the rope. In the fiber core rope in which not a resin solid core but only fiber bundles are used, there is no support by the resin solid core. Thus, in comparison to the solid core rope including the resin solid core, a deformation amount at the time of bending (for example, at the time of passing through the sheave) is large. Therefore, it is confirmed that even when oil is contained in the fiber bundles, fretting wear between strands and between steel wires forming the strands is considerably severe, and more rust is generated than the solid core rope in which only the resin solid core is used.

Meanwhile, in the hybrid core rope of the invention of the present application, the strands are supported by the resin solid core as described above. A deformation amount thereof (the diameter decrease rate of the rope diameter and the extension rate) can be close to the solid core rope in which only the resin solid core is used. Moreover, since the oil is appropriately supplied from the fiber bundles, progress of the rust is very slow. Generation of the rust leads to a strength decrease of the rope. It can be said that in the hybrid core rope of the invention of the present application, the strength decrease is small even after long-term use.

For example, the fiber bundles and the strands are respectively wound in such a manner that an angle made by the fiber bundles and the strands is within a range from 20 degrees to 160 degrees. Thereby, the strands are respectively in contact with the fiber bundles and also brought into contact with the resin solid core by the appropriate number of times for unit length in the longitudinal direction. The number of times for unit length of the contact between the strands and the fiber bundles and the resin solid core is increased more as the angle made by the fiber bundles and the strands is closer to 90 degrees, and the number becomes maximum when the angle is 90 degrees.

In one mode, a ratio between a section area of the resin solid core and a section area of the sum of the plurality of fiber bundles (resin solid core:fiber bundles) is within a range from 80:20 to 40:60. When an area ratio of the resin solid core is 40% or more in a range (an area) occupied by the resin solid core and the fiber bundles, the hybrid core rope can have the substantially same diameter decrease rate, extension rate, and fatigue resistance as the solid core rope having only the resin solid core. When an area ratio of the fiber bundles is ensured by 20% or more, the maintenance task for maintaining the lubricating property described above is reduced.

A reinforcing material may be provided in the resin solid core. Strength or rigidity of the hybrid core rope can be enhanced.

DESCRIPTION OF THE PREFERRED EMBODIMENTS

Figure 1:
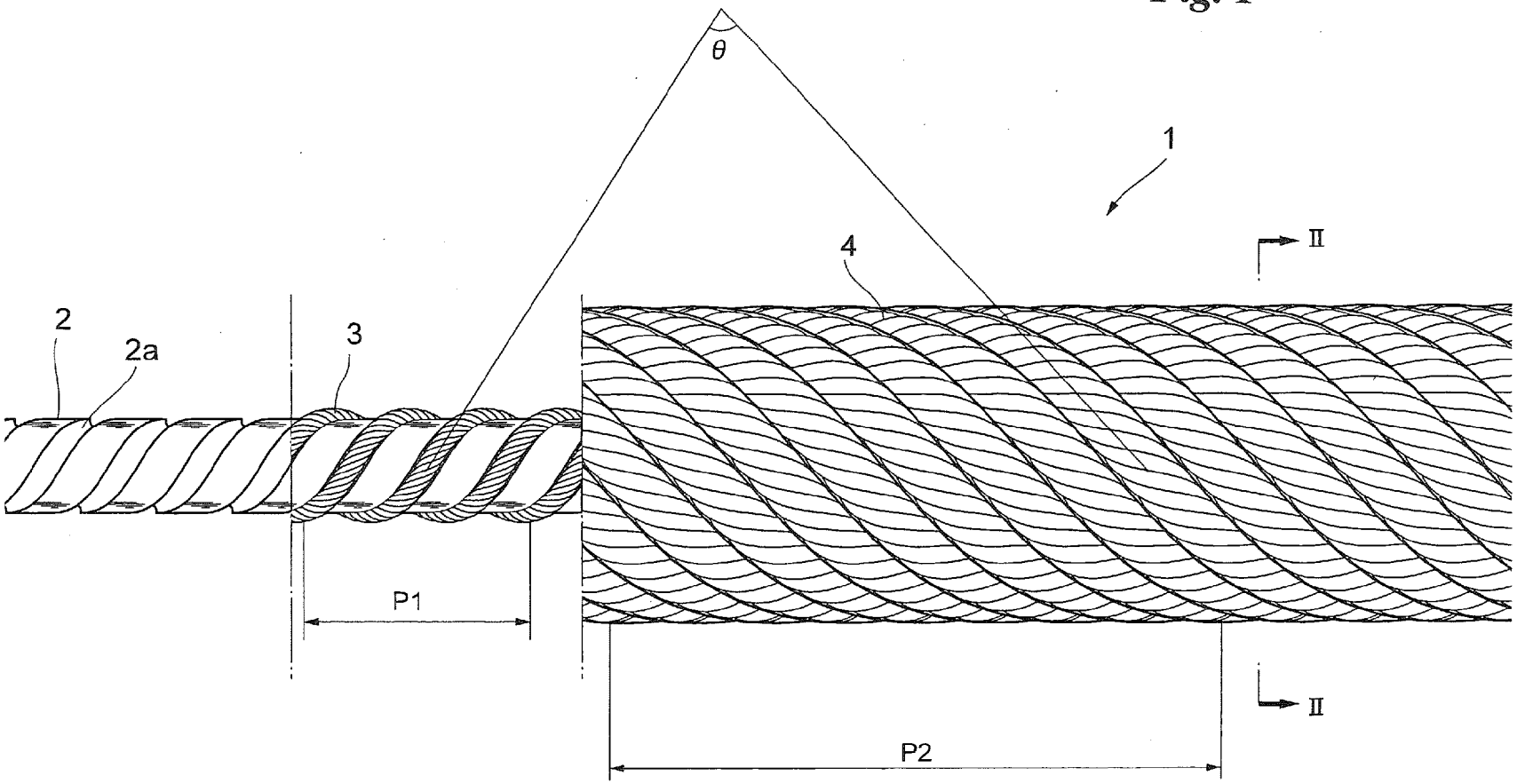
FIG. 1 is a front view of a hybrid core rope.
Figure 2:
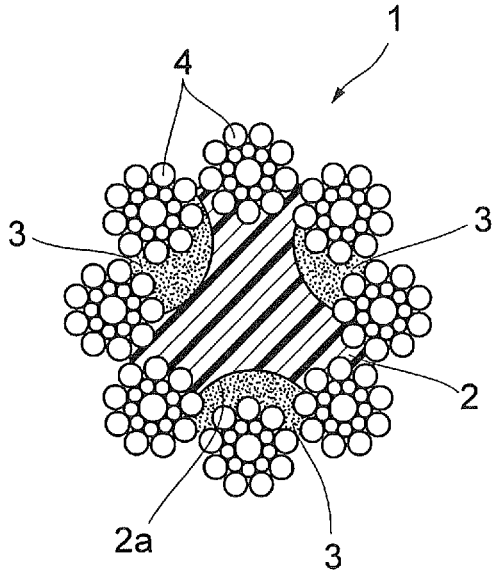
FIG. 2 is a sectional view of the hybrid core rope along the line II-II of FIG. 1.

FIG. 1 shows a front view of a hybrid core rope and FIG. 2 shows a sectional view of the hybrid core rope along the line II-II of FIG. 1. For easy understanding of a structure of the hybrid core rope, FIG. 1 also shows a state that strands are removed from the hybrid core rope (a hybrid core to be described later) and a state that the strands and fiber bundles are removed (a resin solid core to be described later). In FIG. 2, hatching for the strands (a plurality of steel wires forming the strands) is omitted.

One resin solid core 2 is arranged in a center of a hybrid core rope 1. Grooves 2*a* extending in the longitudinal direction of the resin solid core 2 are spirally formed on an outer peripheral surface of the resin solid core 2, and fiber bundles 3 are wound around the spiral grooves 2*a*. Strands 4 are further twisted around the resin solid core 2 and the fiber bundles 3.

The resin solid core 2 is made of polypropylene (PP), polyethylene (PE), polyethylene terephthalate (PET), or a material formed by mixing these materials. Which material to be used and a mixing ratio are appropriately selected in accordance with an environment where the hybrid core rope 1 is used (such as use in an ultraviolet-exposed environment and an outside temperature).

Referring to FIG. 2, in the resin solid core 2, three grooves 2*a* spirally extending in the longitudinal direction are formed on the outer peripheral surface of a long object (a solid round bar) having a diameter of 3 mm to 60 mm and a circular section. The three spiral grooves 2*a* are formed at an equal interval and at an equal pitch to each other, and any of the grooves has a substantially semicircular concave portion in a sectional view. The fiber bundles 3 described in detail next are set in the grooves 2*a*. Two or more spiral grooves 2*a* are preferably formed so that the fiber bundles 3 are equally placed at any points in the longitudinal direction of the hybrid core rope 1.

Each of the three fiber bundles 3 is wounded around each of the three grooves 2*a* formed on the outer peripheral surface of the resin solid core 2. The fiber bundle 3 is formed by bundling and twisting plural natural fiber (such as cotton and hemp) filaments or synthetic fiber filaments. The fiber bundle 3 itself (before becoming part of the hybrid core rope 1) has a substantially circular section, and a diameter thereof depends on the number of the natural fiber filaments or the synthetic fiber filaments to be bundled and is appropriately adjusted in accordance with size of the groove 2*a* formed in the resin solid core 2. Preferably, the diameter of the fiber bundle 3 is to fill the entire groove 2*a* and further slightly run over the groove 2*a*. The fiber bundle 3 may be made of only natural fiber or only synthetic fiber, or a mixture of the natural fiber and the synthetic fiber may be the fiber bundle 3. For easy understanding, in FIG. 1, the fiber bundle is shown by considerably emphasizing thickness of the plural filaments forming the fiber bundle 3.

Hereinafter, an item in which the fiber bundles 3 are set in the grooves 2*a* of the resin solid core 2 described above is called as the "hybrid core 2, 3". In general, the fiber bundles 3 in which oil is preliminarily contained are set in the grooves 2*a* of the resin solid core 2. As a matter of course, the oil can also be contained (or supplemented) into the fiber bundles 3 from the outer peripheral surface of the completed hid core rope 1.

Each of the strands 4 has a 1+9+9 Seale construction and is formed by twisting a total of nineteen steel wires having different diameters and a circular section. By twisting the eight strands 4 around the hybrid core 2, 3 at an equal interval and at an equal pitch, the hybrid core rope 1 having a diameter of about 5 mm to 100 mm is formed. The hybrid core rope 1 shown in FIGS. 1 and 2 is provided with the eight strands 4 each of which is formed by the nineteen steel wires, so as to have an 8×19 construction . As a matter of course, the number of the strands 4 forming the hybrid core rope 1 is not limited to eight and the number of the steel wires forming the strands 4 is not limited to nineteen, needless to say. For example, the hybrid core rope 1 may have a 6×7 construction, a 6×19 construction, a 6×24 construction, a 6×37 construction. The strands 4 are not limited to the Seale construction but a Warrington construction, a Warrington-Seale construction, a Filler construction, or other constructions may be used. In order to provide flexibility to the hybrid core rope 1 and ensure sufficient strength, the number of the strands 4 is preferably six or more.

Referring to FIG. 1, an angle θ made by the fiber bundles 3 and the strands 4, the angle being set by providing the fiber bundles 3 (the grooves 2*a*) and the strands 4 respectively obliquely (spirally) to the longitudinal direction of the hybrid core rope 1 is about 20 degrees to 160 degrees. That is, the fiber bundles 3 (the grooves 2*a*) and the strands 4 have winding angles (twist angles) which are not parallel to each other. Thereby, specific strands 4 among the eight strands 4 are prevented from being continuously in contact with only the fiber bundles 3 and other specific strands 4 are prevented from being continuously in contact with only the resin solid core 2 over the entire length of the hybrid core rope 1. That is, all the eight strands 4 are in contact with the fiber bundles 3 at a certain position in the longitudinal direction of the hybrid core rope 1 and in contact with the resin solid core 2 at the other position. Thereby, the oil oozed out from the fiber bundles 3 can be evenly supplied to the eight strands 4 over the entire length of the hybrid core rope 1. Since the strands 4 are supported by the resin solid core 2 (within a range where the grooves 2*a* are not formed), a diameter decrease rate of the hybrid core rope 1 is lowered and extension is decreased (this will be described in detail later), so that a loss of a shape in an outer form can be prevented.

Further referring to FIG. 1, when a pitch P1 of the fiber bundles 3 (a pitch of the grooves 2*a*) and a pitch P2 of the strands 4 are compared, the pitch P2 of the strands 4 is longer than the pitch P1 of the fiber bundles 3. The pitch P1 and the pitch P2 may be the same or the pitch PI of the fiber bundles 3 may be longer than the pitch P2 of the strands 4. In such a way, the pitch P1 of the fiber bundles 3 and the pitch P2 of the strands 4 can be arbitrarily set. In any case, the fiber bundles 3 and the strands 4 are respectively wound so as not to be parallel to each other.

Figure 3:
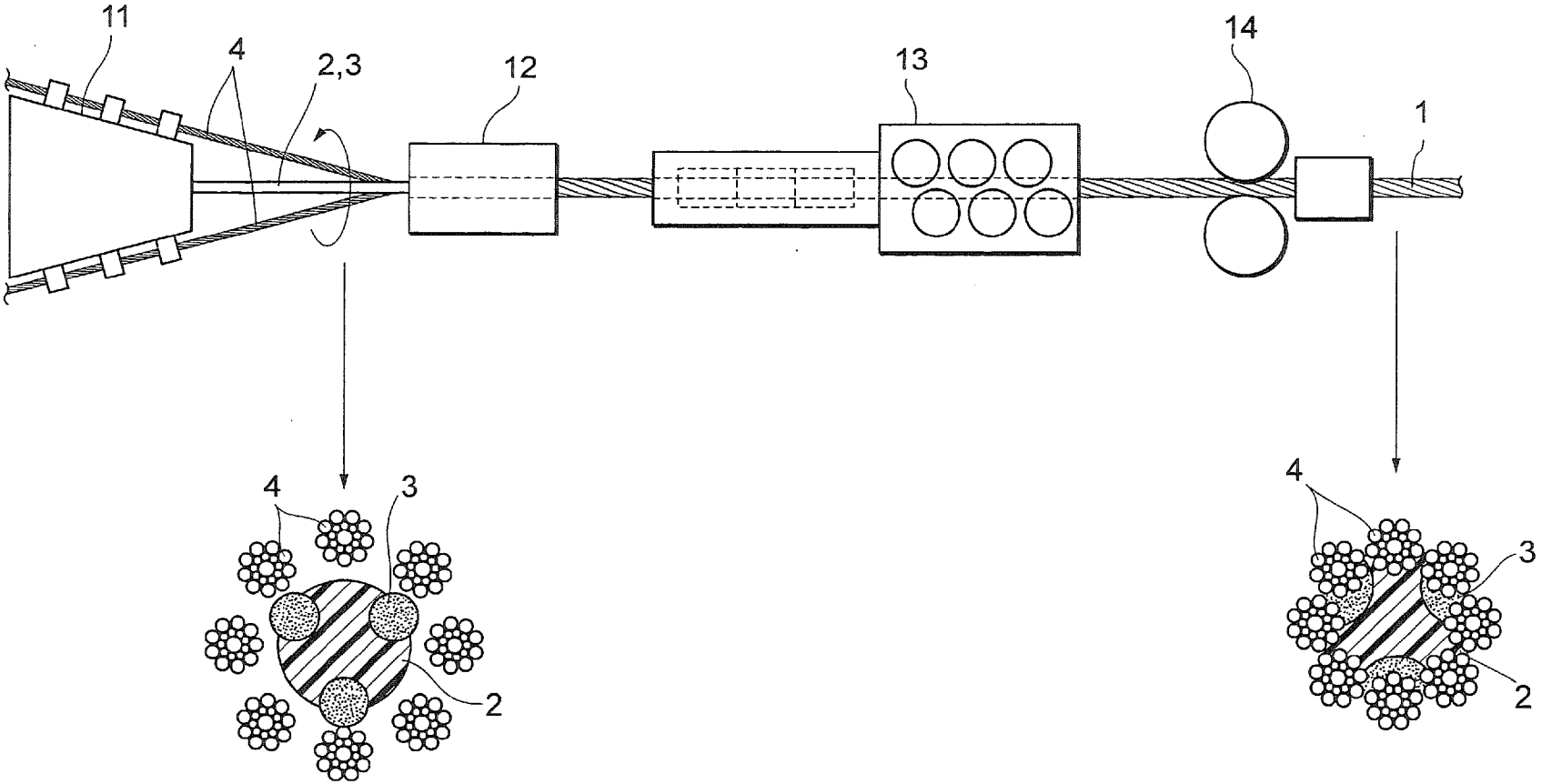
FIG. 3 is a schematic view showing a closing process of strands and a hybrid core.

FIG. 3 schematically shows a closing process of the strands 4 and the hybrid core 2, 3 described above together with rope sections before and after fastening in a stranding die 12. The eight strands 4 (only two strands are shown in FIG. 3) are preliminarily formed into a predetermined shape by a preformer 11 driven to be rotated, and wound around the hybrid core 2, 3 from the outer peripheral side of the hybrid core. The strands 4 and the hybrid core 2, 3 are sent to the stranding die 12, and the hybrid core 2, 3 and the strands 4 are gathered, fastened, and twisted in the stranding die. After that, the hybrid core and the strands are reformed into a straight shape in reformation rolls 13 and rolled from a periphery in diameter adjustment rolling rolls 14, so that the hybrid core rope 1 is completed.

Through the closing process, the eight strands 4 bite into the resin solid core 2 and the fiber bundles 3 (refer to FIG. 2). Conversely, the resin solid core 2 and the fiber bundles 3 are pushed from the outer side to the inner side by the strands 4 so as to be deformed along outer forms of the strands 4. Since each of the strands 4 is formed by the plurality of steel wires, the strands have a retaining force exceeding a repulsive force for letting the deformed resin solid core 2 and fiber bundles 3 return to the original shapes. The fiber bundles 3 and the strands 4 are wound so as to have the angles which are not parallel to each other (as described above, the angle θ made by the fiber bundles 3 and the strands 4 is about 20 degrees to 160 degrees) (refer to FIG. 1). Thus, as described above, in the completed hybrid core rope 1, all the eight strands 4 always have points to be in contact with and bite into the fiber bundles 3 in the longitudinal direction and also always have points to be in contact with and bite into the resin solid core 2.

In order to avoid the fretting wear between the strands 4 in the unused hybrid core rope 1 as much as possible, the fastening is preferably performed to an extent that a slight gap is created between the strands 4 in the closing process. The extent of the fastening is adjusted by a diameter of the stranding die 12 and a pressing force in the diameter adjustment rolling rolls 14.

Hereinafter, a fatigue evaluation test of the hybrid core rope 1 will be described. The fatigue evaluation test was conducted with using six types of ropes including four types of hybrid core ropes (No. 2 to No. 5) in which a ratio between a section area of the resin solid core 2 and a section area of the sum of the three fiber bundles 3 occupying the hybrid core 2, 3 is different from each other, a rope (No. 1) having a core formed only by fiber bundles (hereinafter, referred to as the fiber core rope), and a rope (No. 6) having a core formed only by a resin solid (without any grooves) (hereinafter, referred to as the solid core rope). Table 1 shows area ratios of the resin solid occupying the cores of the six types of ropes No. 1 to No. 6.

TABLE 1

| | Area ratio of resin solid | |
|---|---|---|
| No. 1 | 0% | Fiber core rope |
| No. 2 | 20% | Hybrid core rope |
| No. 3 | 40% | Hybrid core rope |
| No. 4 | 60% | Hybrid core rope |
| No. 5 | 80% | Hybrid core rope |
| No. 6 | 100% | Solid core rope |

Sisal was used for the fiber bundles (a fiber core) contained in the fiber core rope No. 1. Since the fiber core rope does not contain the resin solid, the area ratio of the resin solid of the fiber core rope No. 1 is 0%. Synthetic fiber was used for the fiber bundles contained in the hybrid core ropes No. 2 to No. 5. Polypropylene was used for the resin solid contained in the ropes No. 2 to No. 6. Since the entire core of the solid core rope No. 6 is the resin solid, the area ratio of the resin solid is 100%. The other conditions were the same for all the ropes No. 1 to No. 6. For example, regarding the strands to be twisted around the core, the strands 4 having the 1+9+9 Seale construction described in FIGS. 1 and 2 were used for all the ropes No. 1 to No. 6, and the pitch thereof was also common for all the ropes No. 1 to No. 6.

The area ratio of the resin solid core 2 occupying the hybrid core 2, 3 is differentiated by adjusting size of the grooves 2*a* formed in the resin solid core 2 and the diameter of the fiber bundles 3 set in the grooves 2*a*. The area ratio of the resin solid is increased with the small grooves 2*a* and decreased with the large grooves 2*a*.

Table 2 shows an oil content amount (an oil content rate and an oil amount per unit length) in the ropes No. 1 to No. 6.

TABLE 2

| | Oil content rate (%) | Oil amount per unit length (g/m) |
|---|---|---|
| No. 1 | 11.00 | 3.18 |
| No. 2 | 11.84 | 3.02 |
| No. 3 | 7.86 | 2.71 |
| No. 4 | 5.24 | 1.34 |
| No. 5 | 4.02 | 0.98 |
| No. 6 | 0 | 0 |

The oil content rate (%) is calculated by the following expression.

$$\text{Oil content rate (\%)} = \text{Oil amount per unit length (g/s)} / \text{Weight of entire core per unit length (g/s)} \times 100$$

In the hybrid core ropes 1 (No. 2 to No. 5), the more the area ratio of the resin solid core 2 occupying the hybrid core 2, 3 is increased (that is, the more the area ratio of the fiber bundles 3 is decreased), the more the oil content rate and the oil amount are lowered but any ropes contain oil. The fiber core rope No. 1 also contains the oil as a matter of course. Meanwhile, the solid core rope No. 6 does not have fiber bundles and hence does not contain oil at all. The solid core rope containing no oil lacks a lubricating property between the solid core rope and a sheave over which the rope is placed for example, and the fretting wear between the strands 4 and between the steel wires forming the strands 4 is increased. Thus, in general, there is a need for regularly applying a lubricant (grease) to a surface. On the other hand, in the fiber core rope (No. 1) and the hybrid core ropes (No. 2 to No. 5), the oil is oozed out from the fiber bundles during use. Thus, there is a less need for maintenance from a view of the lubricating property than the solid core rope.

Figure 4:
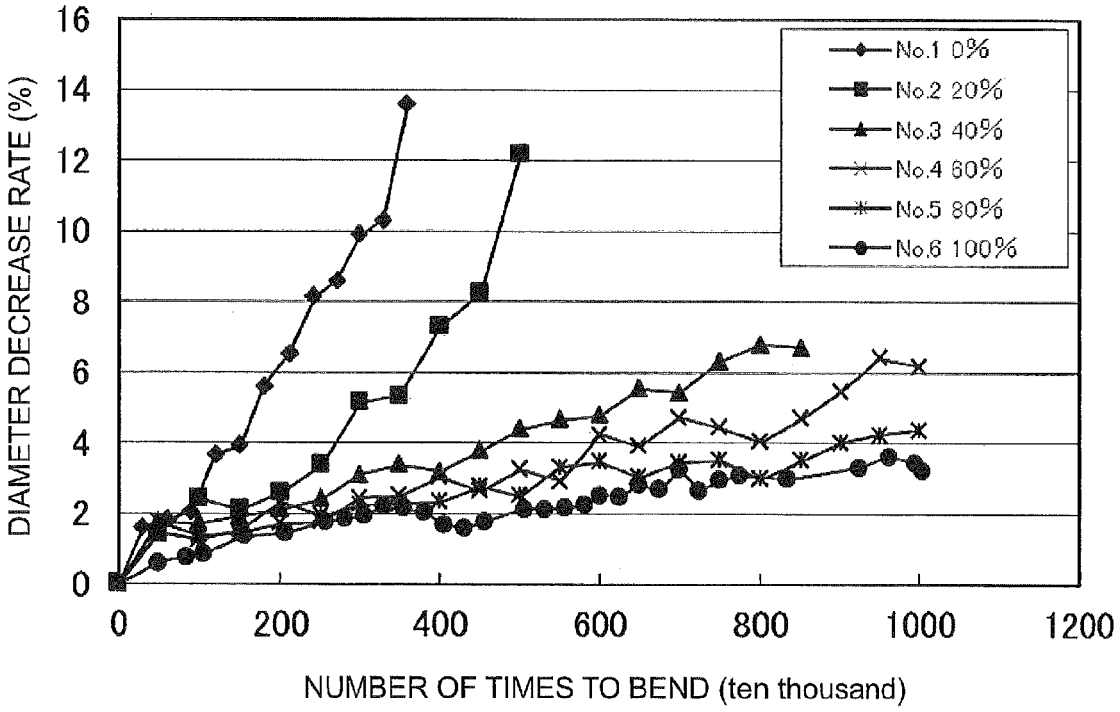
FIG. 4 is a graph showing a diameter decrease rate of the rope in a fatigue test.
Figure 5:
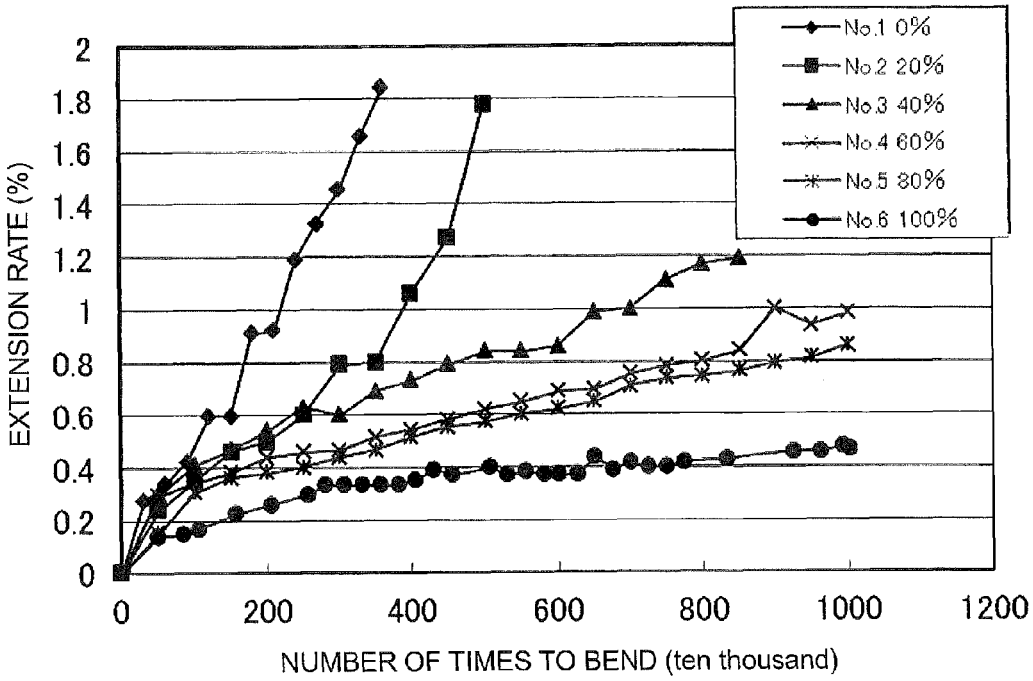
FIG. 5 is a graph showing an extension rate of the rope in the fatigue test.

FIG. 4 is a graph showing the diameter decrease rate ([diameter of unused rope−diameter of rope after test]/diameter of unused rope×100) of the ropes in the fatigue test with the number of times to bend (ten thousand) on the horizontal axis and the diameter decrease rate of the rope (%) on the vertical axis. FIG. 5 is a graph showing the extension rate ([length of rope after test−length of unused rope]/length of unused rope×100) of the ropes in the fatigue test with the number of times to bend (ten thousand) on the horizontal axis and the extension rate of the rope (%) on the vertical axis. The fatigue test was conducted with using a planetary fatigue testing machine By the fatigue test with using the planetary fatigue testing machine, states of the ropes after long-term use can be simulated for a short time.

Irrespective of the number of times to use (corresponding to the number of times to bend in the fatigue test), the smaller diameter decrease rate and extension rate of the rope are more preferable. This is because when the diameter decrease rate is increased with use, that is, the diameter of the rope is decreased, the pitch of the strands 4 forming the rope is increased and extension is generated in the rope, so that a need for maintenance such as a task of shortening a part elongated by the extension arises.

From the graphs of FIGS. 4 and 5, it can be found that the solid core rope (No. 6) is the most excellent and the fiber core rope (No. 1) is the most inadequate for any of the diameter decrease rate and the extension rate. Any of the hybrid core ropes (No. 2 to No. 5) has a performance in the middle of the solid core rope (No. 6) and the fiber core rope (No. 1).

It was confirmed that for any of the diameter decrease rate (FIG. 4) and the extension rate (FIG. 5), the performance is more largely different between the hybrid core rope No. 2 and the hybrid core ropes No. 3 to No. 5 than between other hybrid core ropes. It is found that in order to let the hybrid core ropes deliver the performance close to the solid core rope for the diameter decrease rate and the extension rate, the area ratio of the resin solid core 2 occupying the hybrid core 2, 3 is preferably 40% or more (that is, the ropes No. 3 to No. 5). When the area ratio of the resin solid core 2 is excessively large, there is a need for the same maintenance as the solid core rope from a view of the lubricating property described above. Thus, the area ratio of the resin solid core is preferably 80% or less (that is, the area ratio of the fiber bundles 3 remains about 20%).

Table 3 shows observation results of disconnections (breakings) and evaluations (fatigue resistance evaluations) for the number of times to bend in the fatigue test. The "disconnections" herein indicate disconnections which were able to be visually recognized in the steel wires (filaments) forming the strands 4, and the number of the disconnections for one pitch is shown in "disconnection" sections. Assuming that the ropes are used for an elevator, "evaluation" sections show the evaluations based on whether or not the disconnections of 10% of the total wires were confirmed for one pitch, that is, whether or not sixteen disconnections serving as about 10% of a total of 152 wires in a case of the strands 4 shown in FIGS. 1 and 2 (since the number of the wires is nineteen for one strand 4, the total number of the wires of the eight strands 4 is 19×8=152) were confirmed for one pitch. The symbol "NA" is shown for the ropes in which sixteen or more disconnections were confirmed for one pitch, and the symbol "OK" is shown for the ropes in which sixteen or more disconnections were not confirmed. Since continuation of the fatigue test is meaningless for the ropes in which sixteen or more disconnections were confirmed, the test was finished at the time point. This is shown by a dash ("-") in Table 3.

TABLE 3

| | Number of times to bend (ten thousand) | | | | | | | | | |
|---|---|---|---|---|---|---|---|---|---|---|
| | 100 | | 200 | | 300 | | 400 | | 500 | |
| | Disconnection | Evalution | Disconnection | Evalution | Disconnection | Evalution | Disconnection | Evalution | Disconnection | Evalution |
| No. 1 | 0 | OK | 0 | OK | 0 | OK | 21 | NA | — | — |
| No. 2 | 0 | OK | 0 | OK | 0 | OK | 6 | OK | 19 | NA |
| No. 3 | 0 | OK | 0 | OK | 0 | OK | 0 | OK | 1 | OK |
| No. 4 | 0 | OK | 0 | OK | 0 | OK | 0 | OK | 0 | OK |
| No. 5 | 0 | OK | 0 | OK | 0 | OK | 0 | OK | 0 | OK |
| No. 6 | 0 | OK | 0 | OK | 1 | OK | 1 | OK | 1 | OK |

| | Number of times to bend (ten thousand) | | | | | | | | | |
|---|---|---|---|---|---|---|---|---|---|---|
| | 600 | | 700 | | 800 | | 900 | | 1000 | |
| | Disconnection | Evalution | Disconnection | Evalution | Disconnection | Evalution | Disconnection | Evalution | Disconnection | Evalution |
| No. 1 | — | — | — | — | — | — | — | — | — | — |
| No. 2 | — | — | — | — | — | — | — | — | — | — |
| No. 3 | 1 | OK | 5 | OK | 11 | OK | 17 | NA | — | — |
| No. 4 | 0 | OK | 0 | OK | 0 | OK | 4 | OK | 4 | OK |
| No. 5 | 0 | OK | 0 | OK | 0 | OK | 0 | OK | 2 | OK |
| No. 6 | 1 | OK | 1 | OK | 1 | OK | 1 | OK | 1 | OK |

For example, regarding the fiber core rope No. 1, although no disconnections were found at the time point after bending for 3 million times, twenty-one disconnections for one pitch were found at the time point after repeatedly bending for 4 million times. Since sixteen or more disconnections were found at the time point after repeatedly bending for 4 million times, the symbol "NA" is shown in the evaluation section of 4 million times and no subsequent fatigue test was conducted.

As clear from Table 3, it was confirmed that for the fatigue resistance, the performance is also more largely different between the hybrid core rope No. 2 and the hybrid core ropes No. 3 to No. 5 than between other hybrid core ropes. It is found that in order to let the hybrid core ropes deliver the performance close to the solid core rope (No. 6) for the fatigue resistance, the area ratio of the resin solid core 2 occupying the hybrid core 2, 3 is preferably 40% or more (that is, the ropes No. 3 to No. 5).

Regarding the diameter decrease rate, the extension rate, and the fatigue resistance, the performance is somewhat better in the solid core rope (No. 6) than in the hybrid core ropes (No. 2 to No. 5). However, when the surfaces of the ropes were confirmed during the fatigue test, it was confirmed that almost no rust was generated on the surfaces of the hybrid core ropes (No. 2 to No. 5) whereas rust was generated on the surface of the solid core rope (No. 6). This is thought to be because the solid core rope (No. 6) does not contain the oil (incapable of containing the oil) (refer to Table 2) and the fretting wear between the strands 4 and the fretting wear between the steel wires forming the strands 4 are relatively severe. It was also confirmed that the rust was generated the most in the fiber core rope (No. 1). This is thought to be because although the fiber core rope (No. 1) can contain much oil, the strands 4 are not supported by the resin solid unlike the ropes containing the resin solid (No. 2 to No. 6), so that a deformation amount of the rope (the strands 4) is large at the time of passing through the sheave (at the time of bending), and therefore, the fretting wear between the strands 4 and the fretting Wear between the steel wires forming the strands in use are dramatically severe. In such a way, in the fatigue test, it was confirmed that the rust is less easily generated in the hybrid core ropes (No. 2 to No. 5) than the fiber core rope (No. 1) and the solid core rope (No. 6). Generation of the rust leads to a strength decrease of the ropes. Thus, from this view, it was able to be confirmed that the performance was the best in the hybrid core ropes (No. 2 to No. 5).

Figure 6:
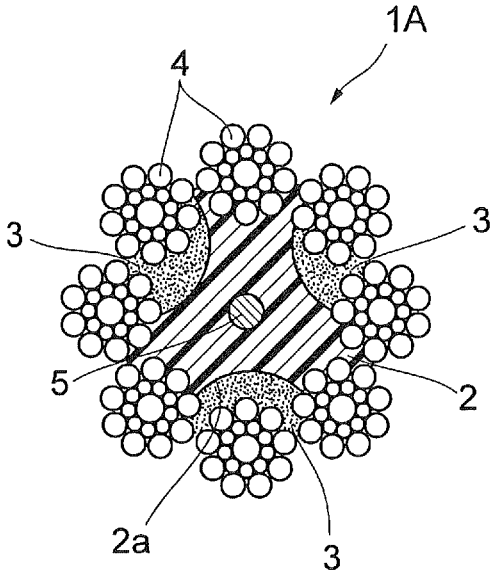
FIG. 6 is a sectional view of the hybrid core rope of another embodiment.

FIG. 6 is a sectional view of a hybrid core rope 1A of another embodiment. The hybrid core rope 1A is different from the hybrid core rope 1 shown in FIG. 2 in a point that a steel cord 5 serving as a reinforcing material is provided in a center of the resin solid core 2 over the entire length of the hybrid core rope 1A in the longitudinal direction. By embedding the steel cord 5 in the resin solid core 2, strength or rigidity of the hybrid core rope 1A can be enhanced. As the reinforcing material, not only the steel cord 5 but also a synthetic fiber wire made of nylon, polyester, or the like, natural fiber wire made of cotton, hemp, or the like, or other wires may be used. As a matter of course, a plurality of steel cords 5 may be embedded in the resin solid core 2.

What is claimed is:

1. A hybrid core rope, comprising:

a resin solid core in which a plurality of spiral grooves is formed in a longitudinal direction on an outer peripheral surface of the resin solid core in advance;

a plurality of fiber bundles respectively spirally wound around the outer peripheral surface of the resin solid core along the plurality of spiral grooves, the fiber bundles having thickness to fill the spiral grooves; and a plurality of steel strands spirally wound around the outer peripheral surface of the resin solid core around which the fiber bundles are wound, wherein the fiber bundles and the strands are respectively wound so as to have angles which are not parallel to each other, and wherein the plurality of strands is in contact with the fiber bundles at a certain position in the longitudinal direction and in contact with the resin solid core at another position.

2. The hybrid core rope according to claim 1, wherein an angle made by the fiber bundles and the strands is within a range from 20 degrees to 160 degrees.

3. The hybrid core rope according to claim 1, wherein a ratio between a section area of the resin solid core and a section area of a sum of the plurality of fiber bundles, as resin solid core : fiber bundles, is within a range from 80:20 to 40:60.

4. The hybrid core rope according to claim 1, wherein a reinforcing material is provided in the resin solid core.

5. The hybrid core rope according to claim 1, wherein the strands are other than continuously in contact with only the fiber bundles.

6. The hybrid core rope according to claim 5, wherein the strands are further other than continuously in contact with only the resin solid core.

7. The hybrid core rope according to claim 1, wherein the strands abut the fiber bundles at the certain position in the longitudinal direction.

8. The hybrid core rope according to claim 7, wherein the strands further abut the resin solid core at said another position in the longitudinal direction.

9. The hybrid core rope according to claim 1, wherein the certain position comprises:

a first position that the plurality of strands is in contact with the fiber bundles; and a second position that the plurality of strands is in contact with the fiber bundles, in a cross-sectional view of the hybrid core rope, the second position being spaced apart the first position.

10. The hybrid core rope according to claim 9, wherein, in the cross-sectional view of the hybrid core rope, said another position is located between the first position and the second position on the outer peripheral surface of the resin solid core.

11. The hybrid core rope according to claim 1, wherein, in a cross-sectional view of the hybrid core rope, at the certain position, the fiber bundles spaces apart the strands from the resin solid core.

12. The hybrid core rope according to claim 1, wherein, in a cross-sectional view of the hybrid core rope, at the certain position, the fiber bundles is disposed between the strands and the resin solid core.

13. The hybrid core rope according to claim 1, wherein, in a cross-sectional view of the hybrid core rope, the outer peripheral surface of the resin solid core comprises a surface that extends between two adjacent grooves of the plurality of spiral grooves.

14. The hybrid core rope according to claim 13, wherein the certain position is located on the surface of the resin solid core extending between the two adjacent grooves.

* * * * *